US006341972B1

(12) United States Patent
Odorfer

(10) Patent No.: US 6,341,972 B1
(45) **Date of Patent: *Jan. 29, 2002**

(54) CONNECTOR WITH SECONDARY LATCHING AND WITH A LATERAL CABLE OUTLET

(75) Inventor: Frank Odorfer, Nurnberg (DE)

(73) Assignee: Framatome Connectors International, Courbevoie (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,947

(22) PCT Filed: Apr. 21, 1997

(86) PCT No.: PCT/EP97/02007

§ 371 Date: Feb. 3, 1999

§ 102(e) Date: Feb. 3, 1999

(87) PCT Pub. No.: WO97/41623

PCT Pub. Date: Nov. 6, 1997

(30) Foreign Application Priority Data

| | | |
|---|---|---|
| Apr. 30, 1996 | (DE) | 196 17 374 |
| May 3, 1996 | (DE) | 196 17 819 |
| May 3, 1996 | (DE) | 196 17 820 |
| May 3, 1996 | (DE) | 196 17 792 |

(51) Int. Cl.[7] ..... H01R 13/627

(52) U.S. Cl. ..... 439/352; 439/466

(58) Field of Search ..... 439/352, 353, 439/465, 466, 467, 731

(56) References Cited le;.5qU.S. PATENT DOCUMENTS

| | | | | |
|---|---|---|---|---|
| 4,280,746 A | | 7/1981 | Ignatowicz | 339/107 |
| 4,822,286 A | | 4/1989 | Bianca | 439/610 |
| 5,112,243 A | | 5/1992 | Chow et al. | 439/352 |
| 5,217,390 A | * | 6/1993 | Nozaki et al. | 439/489 |
| 5,275,575 A | | 1/1994 | Cahaly et al. | 439/188 |
| 5,295,859 A | | 3/1994 | Kawai et al. | 439/455 |
| 5,435,742 A | | 7/1995 | Cecil, Jr. | 439/347 |

FOREIGN PATENT DOCUMENTS

| | | |
|---|---|---|
| DE | 4317344 A1 | 12/1994 |
| DE | 4430358 A1 | 4/1995 |
| DE | 4414348 A1 | 10/1995 |
| DE | 29514740 U1 | 1/1996 |
| EP | 0591947 A2 | 4/1994 |
| EP | 0667655 A2 | 8/1995 |
| EP | 0693799 A2 | 1/1996 |
| EP | 0734100 A2 | 9/1996 |
| FR | 2726131 | 4/1996 |

OTHER PUBLICATIONS

PCT Intnernational Search Report.

* cited by examiner

*Primary Examiner*—Neil Abrams
*Assistant Examiner*—Javaid Nasri
(74) *Attorney, Agent, or Firm*—Perman & Green, LLP

(57) ABSTRACT

The invention relates to a connector (1) with secondary latching comprising a handle (2) for filling slots (3*a,* 3*b*) into each of which a tongue (4*a,* 4*b*) with a latch (5*a,* 5*b*) is inserted. The handle (2) engages a plug part (21) in a first position (I) in which the slots are not filled by two arms on the handle, and is mounted so as to be movable transversely to the plug axis into a position (II) in which the arms can be pressed into the slots (3*a,* 3*b*) and locked in a second position (II).

Furthermore, the invention relates to a connector with a lateral cable outlet comprising a plug part (1) having an attachment (2) and an adjacent casing which is flat transversely to the direction of insertion. The cable outlet (40) has a two-part clamping device (50*a,* 50*b*) which firmly clamps the cable (46) at the outlet of the casing, and an upper hollow substantially semicylindrical groove (50*a*) with retaining ribs (47) is formed in an attachment (48) integral with a lid (45) of the casing and having two vertical side walls (51*a,* 51*b*). A second hollow semicylindrical clamp (49) is secured to the casing by retaining ribs (47) so as to be latchable at the insides of the side walls.

6 Claims, 8 Drawing Sheets

CONNECTOR WITH SECONDARY LATCHING AND WITH A LATERAL CABLE OUTLET

The invention relates to a connector with secondary latching.

Connectors of this kind are used e.g. in the motor industry in order to produce electric connections which meet exacting requirements. The requirements relate on the one hand to the reliability with which such a connection must be made and on the other hand to protection against inexpert handling of the connector. The secondary latching is designed to ensure that when the latch closure has engaged, its position is subsequently secured so that the connection cannot be accidentally broken, e.g. by pulling the connection cable in question. On the other hand the secondary latching can be designed so that it also engages and can subsequently be released by hand or only with a special tool. This prevents unauthorised opening. These requirements apply particularly to passenger-retaining systems in motor vehicles, where the connector connects the trigger of an airbag propelling charge, e.g. in the impact cup of a steering wheel, to the vehicle power circuit. During assembly of conventional connectors of this kind, problems occur regarding clear recognition of the state in which the connector is in during assembly. In other words sometimes the person installing the airbag is not sure whether actuation of the secondary-device handle will engage it in the locked position or whether it has already engaged and therefore cannot be correctly inserted. If this happens at an unduly early stage during installation, during subsequent assembly and particularly when the electric power system starts up, the ignition charge may be subjected to voltages which trigger the airbag system. This may result in dangerous injury to the fitters, or the circuit may not be closed in which case the airbag will not operate.

In addition, even when relatively strong forces act on the handle of the secondary latching, engagement in the locked position should be possible only if expressly desired. The purpose is e.g. to avoid faulty operation during transport and handling.

The present invention further relates to a connector with a lateral cable outlet of the kind described in the preamble of claim 17. Connectors of the aforementioned kind, with a lateral cable outlet and a casing which is flat in the direction of insertion, are used whenever it is necessary, for reasons of space, to bend the connecting cable by about 90° from the axis of the connector, immediately behind the plug attachment. A situation of this kind occurs e.g. with ignition plugs for airbag-retaining systems, where the airbag and the ignition mechanism are disposed on the impact cup of the steering wheel, where the overall height is restricted.

In the case of connectors with a lateral cable outlet and a flat casing, there is always a risk that their cable will be pulled out of the mating connector. Although this method of disengaging the connector is not according to specifications, precautions must be taken to reduce the damage in this case to a minimum. This means that the plug casing must not be torn apart and possibly irreversibly deformed by the resulting lever forces. It is also necessary to prevent the cable ends from being partly or completely disconnected from the backs of the plug.

The object of the invention therefore is to propose a connector with secondary latching and having a state on assembly which is clearly defined at all times and has maximum reliability for avoiding unintentional premature latching.

The further object of the invention is to improve a connector according to the invention with a lateral cable outlet so that when an axial or oblique pull is exerted on the cable end, it is effectively protected from disconnection and damage to the casing.

These problems are solved according to the claims. Advantageous embodiments of the invention are specified in the sub-claims.

In order to show the fitter the exact position in which the connector according to the invention is, there are two engaged positions—a first position in which the secondary latching is not yet operative, so that the plug can still be pulled out, and a second position in which the connector is latched and a special tool may be needed to release the handle.

According to another feature of the invention, a locking slide is provided in the lid of the casing of the connector, so as to prevent the secondary latching being pressed down out of the assembly position into the latched position unless the locking slide is deliberately pushed sideways. This reliably prevents accidental final latching during assembly.

Alternatively the handle is disposed so as to be movable transversely to the direction of insertion, so that in the assembly position the handle cannot be pressed into the latched position, this being possible only after being deliberately moved sideways into a position in which the handle can be pressed into the latched position.

These features ensure that faulty operation during assembly is substantially prevented, and during assembly the fitter will always know the exact state of the connector when installed, so that it cannot be latched prematurely.

The invention will now be explained in detail by a description of preferred embodiments with reference to the drawings in which.

Figure 5:
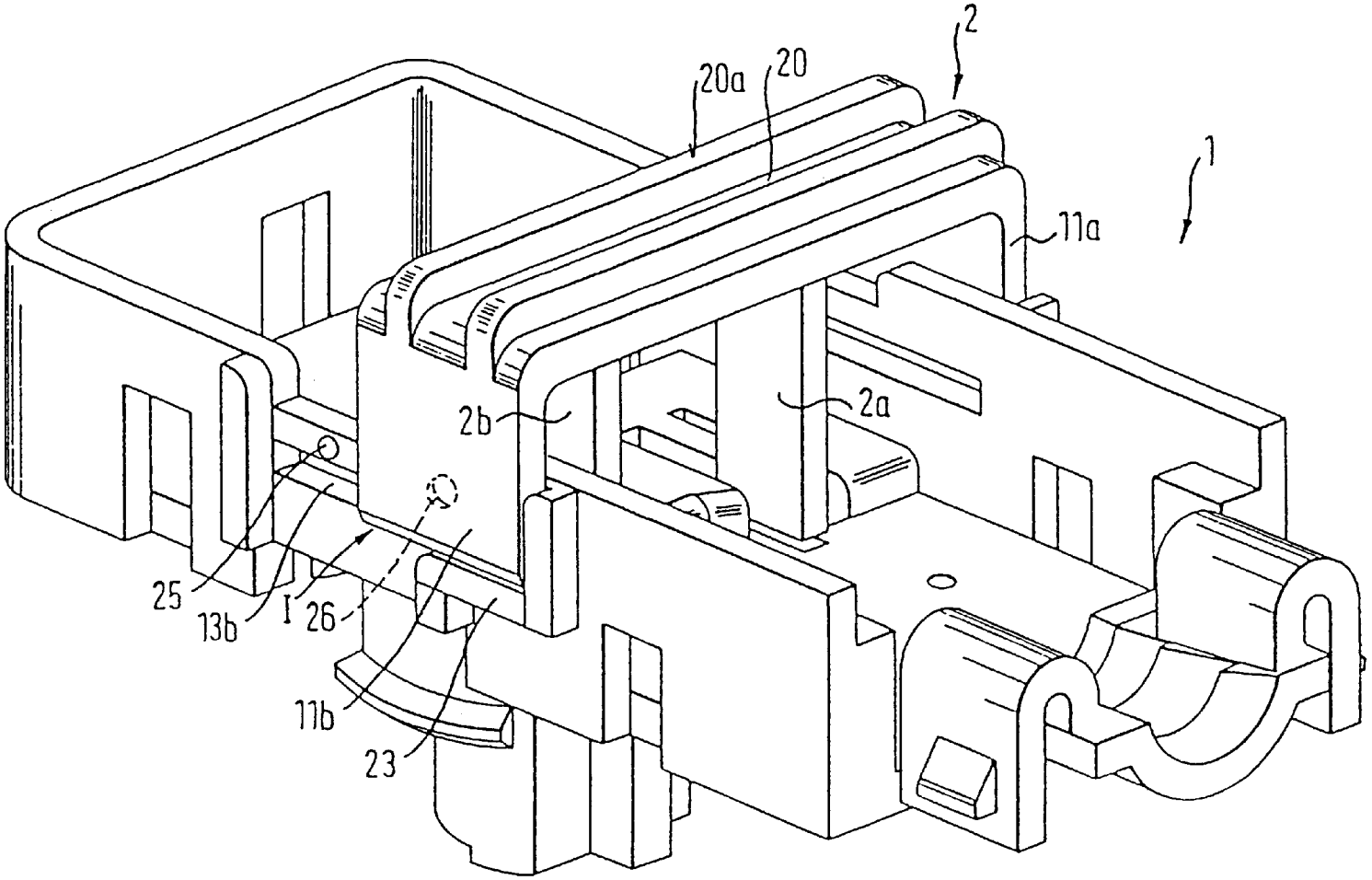
FIG. 5 shows an alternative latching-preventing means in perspective view.
Figure 6A:
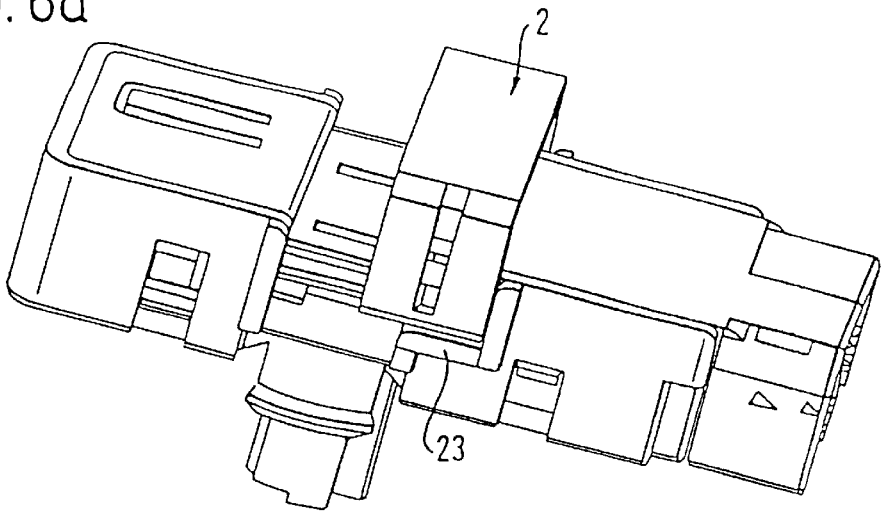
Figure 6B:
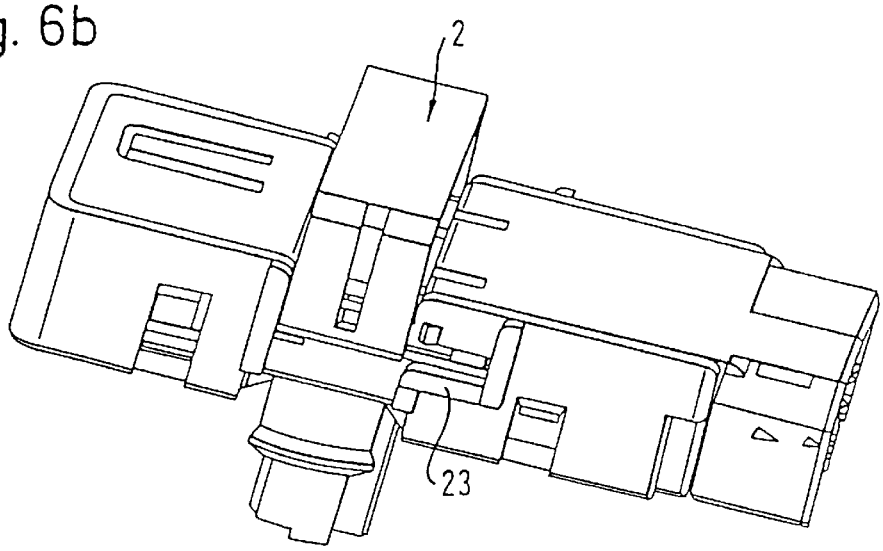
Figure 6C:
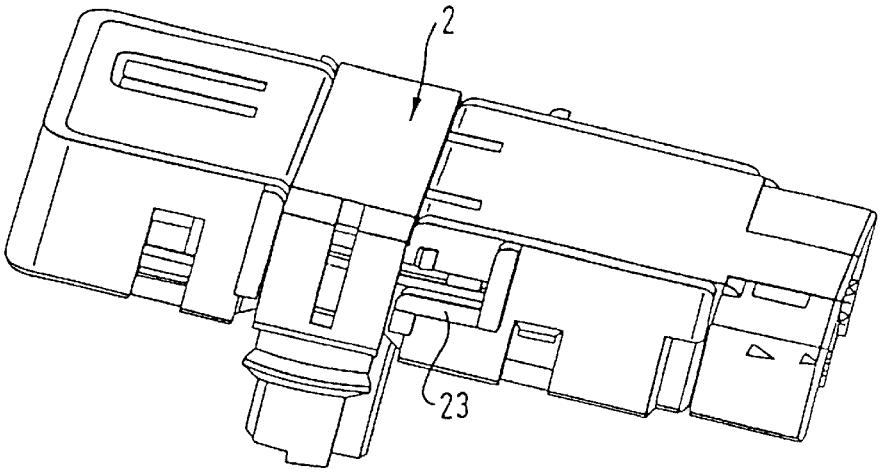
Figure 7:
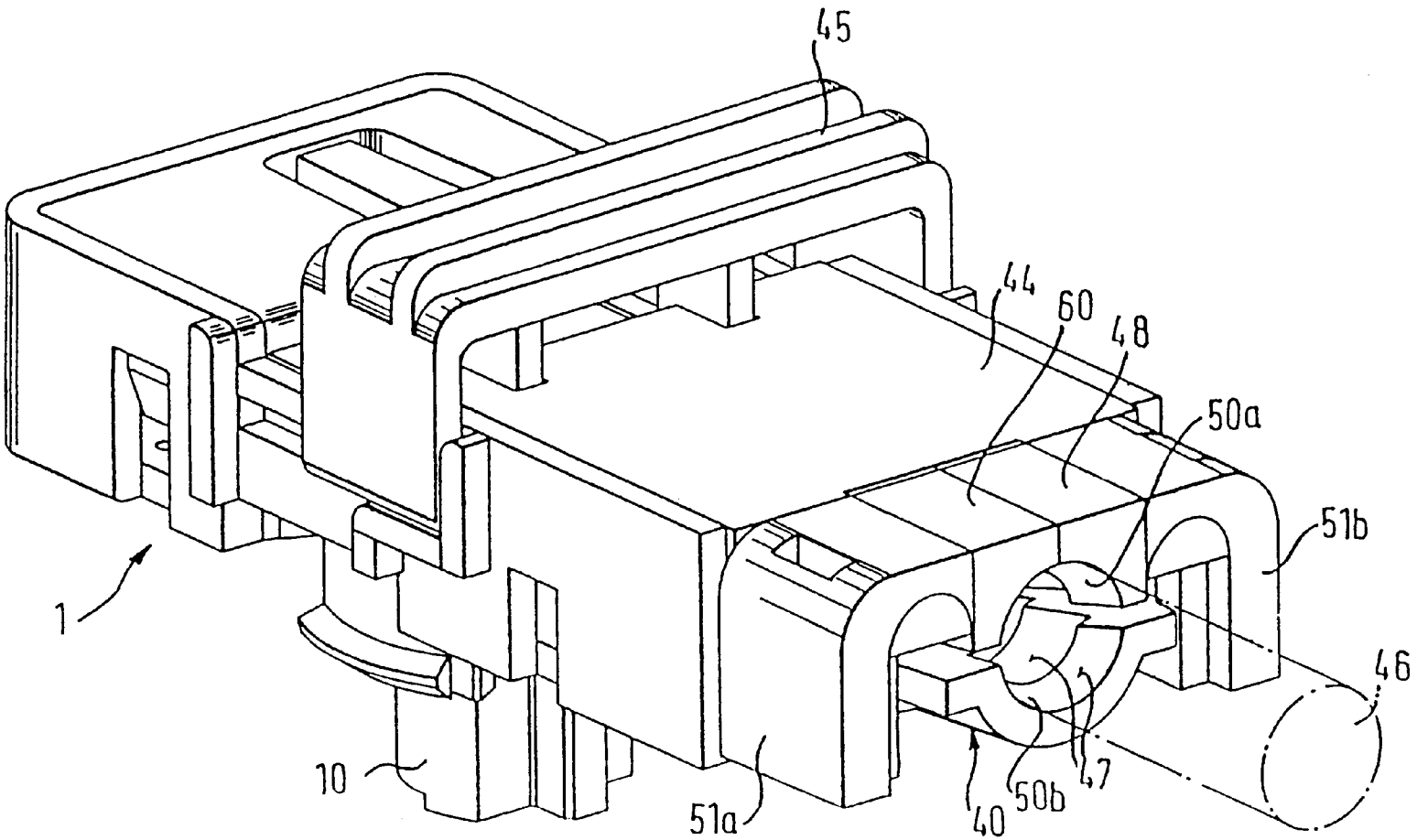
Figure 8:
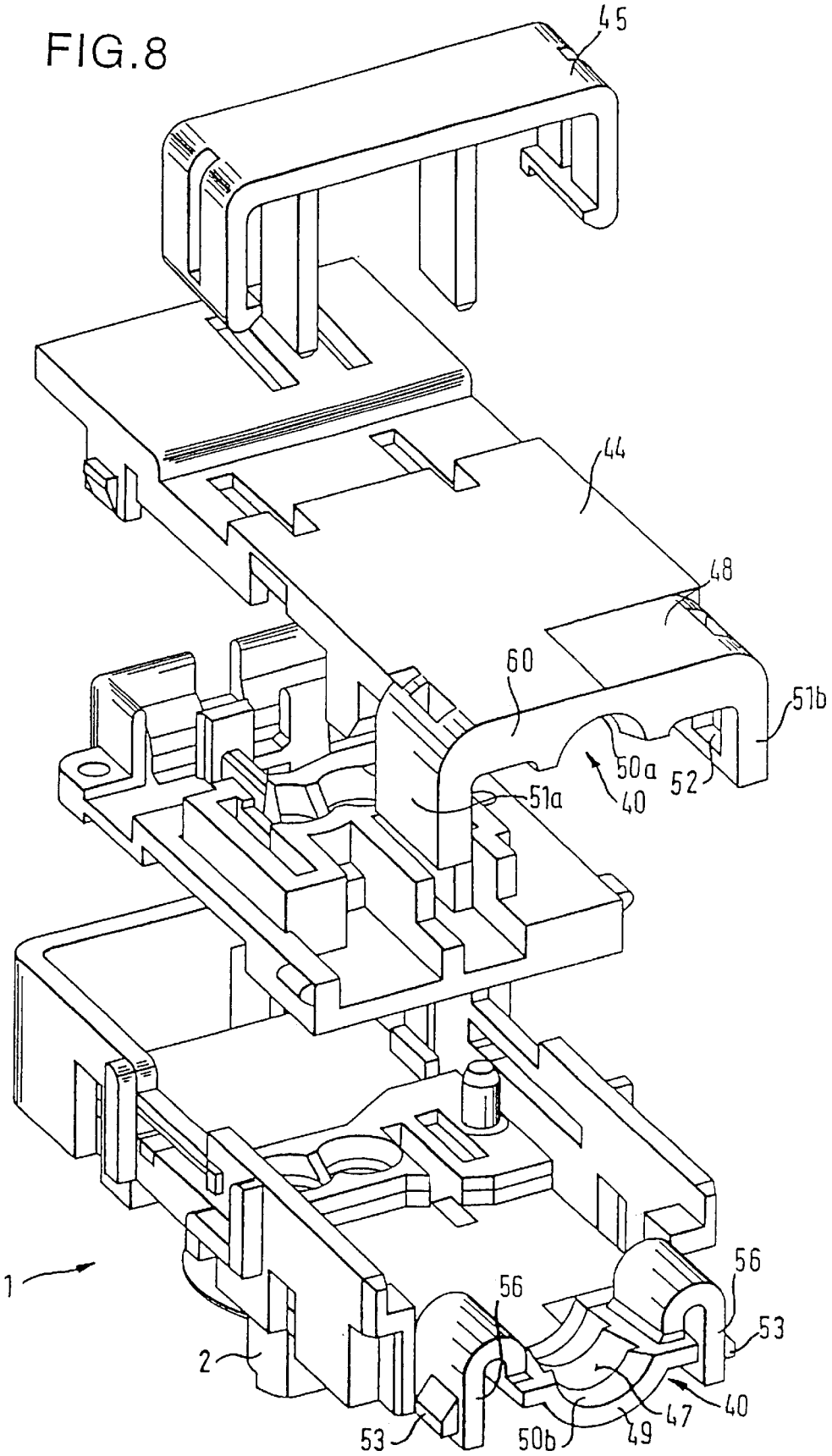

FIG. 6*a–c* shows the latching-preventing means in FIG. 5 in three latch positions;

FIG. 7 is a perspective view of the connector according to the invention and FIG. 8 is an exploded view of the connector in FIG. 7.

Figure 1:
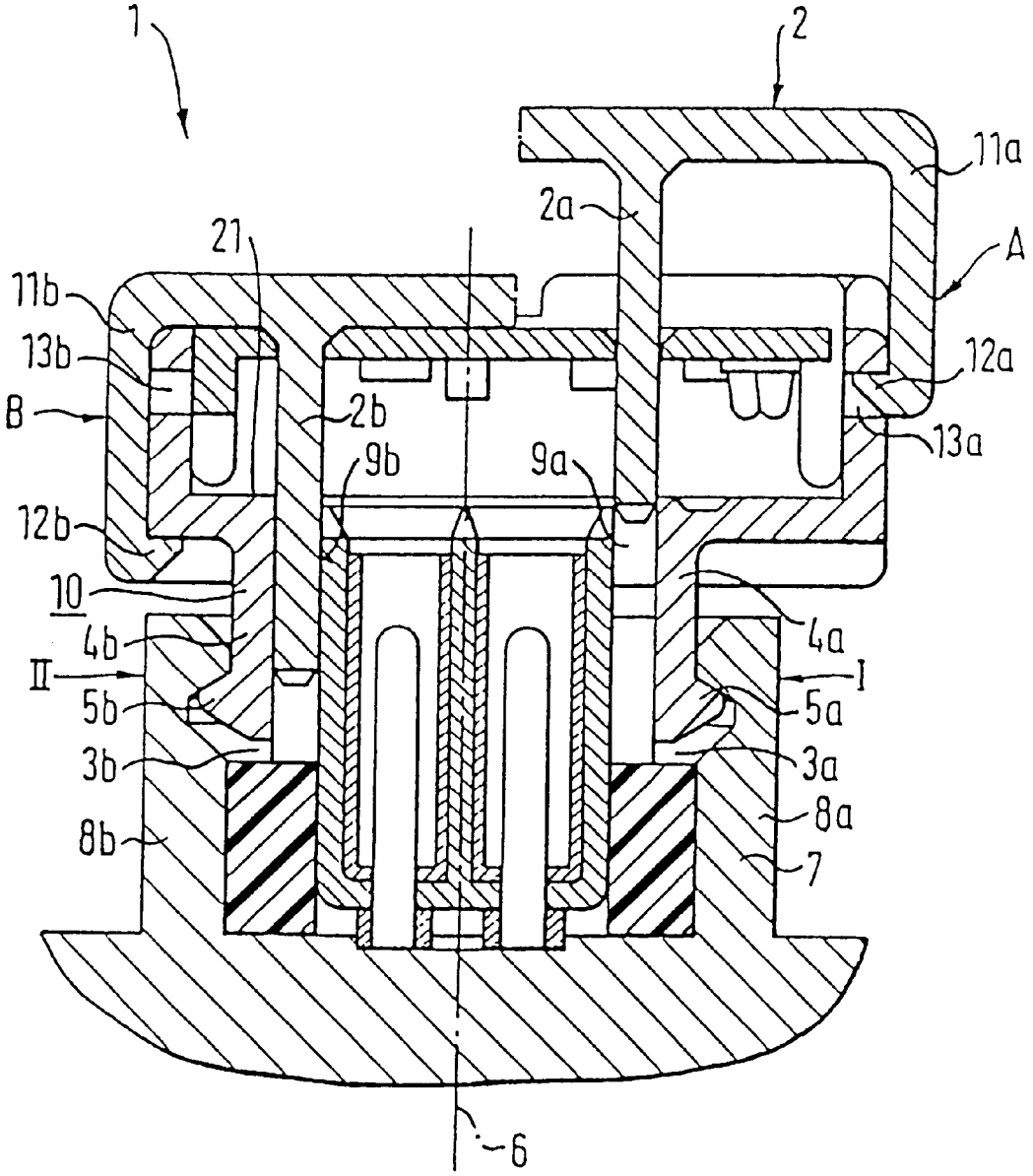
FIG. 1 shows an embodiment of a connector according to the invention in section and in the assembly and in the latched position.

FIG. 1 is a longitudinal section through a connector 1 comprising a plug part 10 and a socket part 7. The socket part 7, in the case of an airbag-retaining system, is a part of the casing of the ignition mechanism. On each side of the plug axis 6, the plug part 10 has tongues 4*a,* 4*b* which engage in corresponding slots 3*a,* 3*b* in the socket part 7, where latches 5*a,* 5*b* engage in undercuts the shoulders 8*a* and 8*b* of in the slots 3*a,* 3*b*. In the case shown here, the latches have sloping flanks on each side, so that after engagement, the plug part 10 can be pulled out by pulling it strongly. The slots 3*a,* 3*b* have a width such that after the latches 5*a,* 5*b* have engaged behind the tongues 4*a,* 4*b* an additional slot 9*a,* 9*b* for receiving the locking arms 2*a,* 2*b* of the handle 2 is formed in the direction of the plug axis 6.

FIG. 1 shows the handle 2 in the assembly position A on the right half and in the latched position B on the left half.

Figure 2:
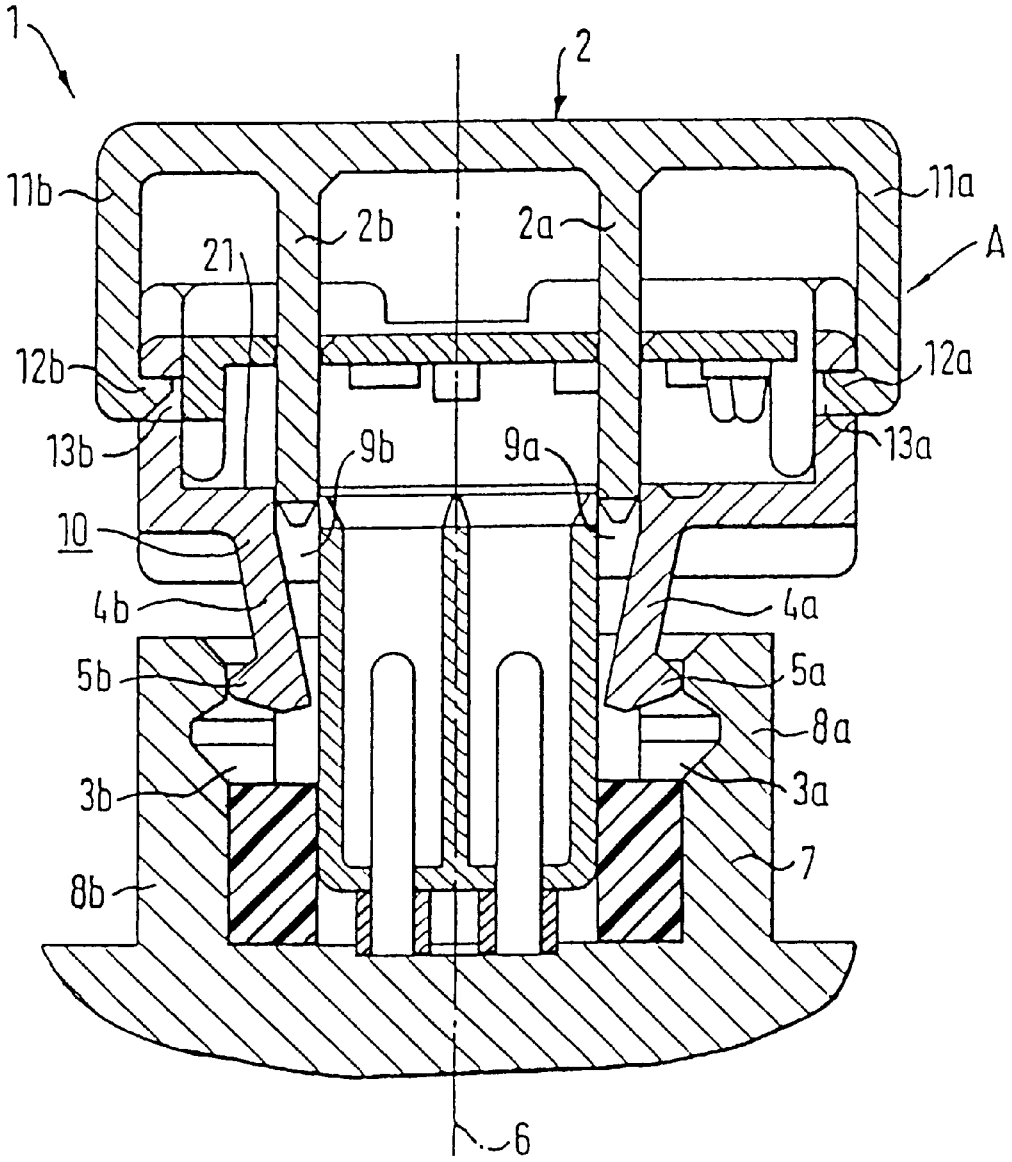
FIG. 2 shows a variant of the embodiment in FIG. 1, in the assembly position.

In the assembly position, the locking arms 2*a,* 2*b* are not received in the slots 9*a,* 9*b.* On each side the lateral wings 11*a,* 11*b* surround the plug part 10 and the latch hooks 12*a,* 12*b* engage in corresponding grooves formed in the side walls of the plug part 10, so as to lock the handle 2 in this assembly position. In this position, therefore, the plug part 10 can be fitted on the socket part 7, and can also be released from this position by strong pulling, since the latches 5*a,* 5*b* can pivot out of the corresponding undercuts. This situation is shown in FIG. 2, which clearly shows that the tongues 4*a,* 4*b* pivot in the free slots 9*a,* 9*b.*

In order finally to latch the connector 1, the handle 2 is pressed in the direction for insertion, so that the sloping end faces of the latch hooks are pressed out of the slots 13*a,* 13*b,* slide along the side walls of the plug part 10, and finally are latched to the lower edge of the side walls of the plug part 10. In this position the locking arms 2*a,* 2*b* have entered the slots 9*a,* 9*b* and prevent the latches 5*a,* 5*b* from swinging back, thus ensuring that the connector has actually been latched. The handle 2 can be latched to the lower edges of the side walls of the plug part 10 in such a manner that a special tool is necessary for releasing it.

Figure 3:
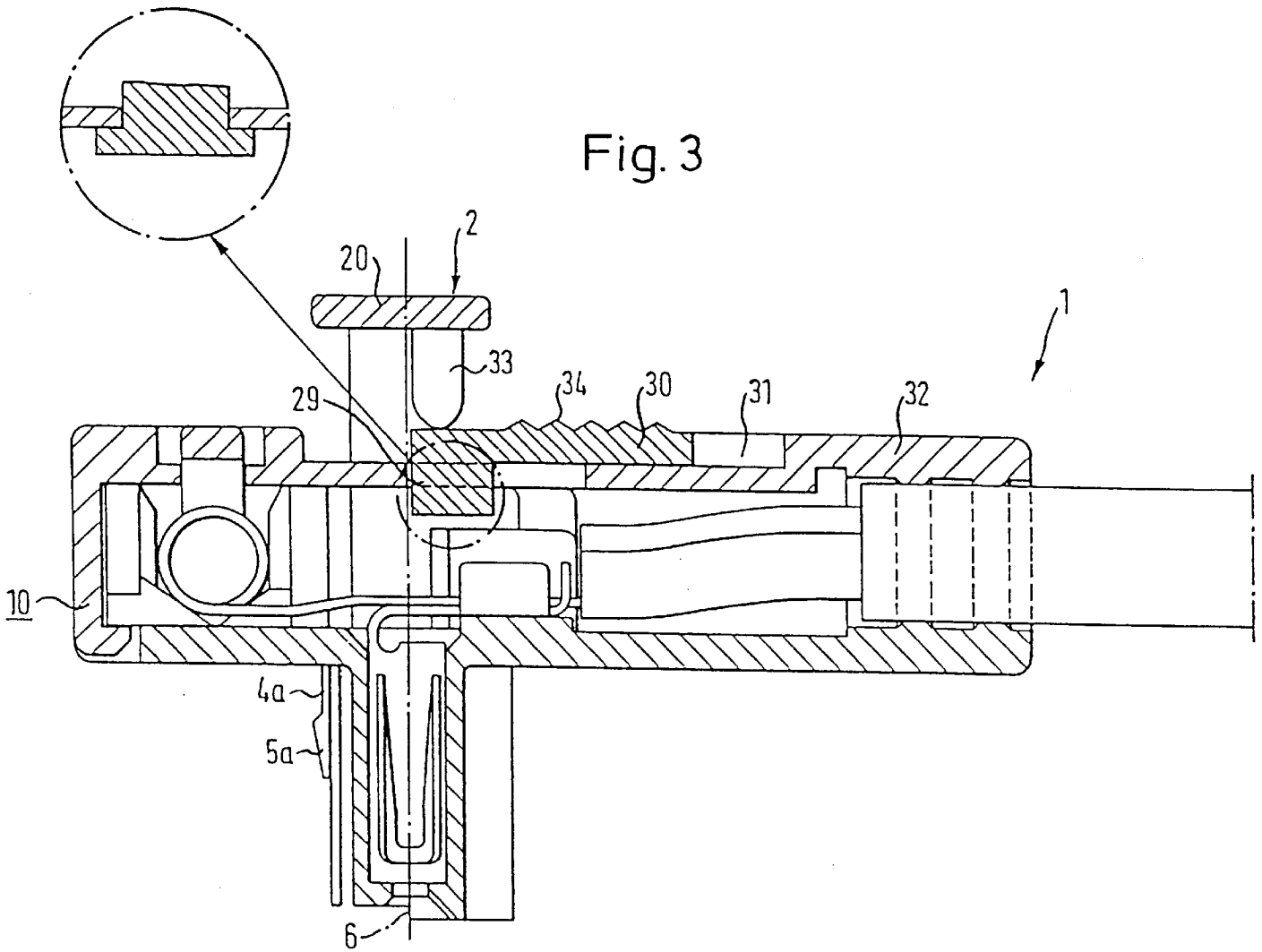
FIG. 3 is a view in cross-section of a connector according to the invention with a locking slide for preventing premature latching.

FIG. 3 shows the plug part 10 in longitudinal section. The cable outlet is shown on the right side and a chamber e.g. for a choke is provided on the left side. The handle 2 is on the plug axis 6 and is shown in FIG. 3 in the assembly position, i.e. the locking arms 2*a,* 2*b* are not completely inserted into the slots 9*a,* 9*b.* The locking slide 30 prevents the handle 2 from being pressed into the latched position. The slide is mounted in a groove 31 in the casing lid 32 so as to be movable transversely to the direction 6 of engagement and can be moved between a locking position and a position in which it enables the handle 2 to be inserted. In the locking position, the locking slide 30 is engaged by suitable latches 29 on the lid and on the slide. On its surface, the locking slide 30 has grooves 34 which facilitate sliding thereof and enable the locking slide to terminate flush with the lid surface, so that the resulting connector has a very flat construction, particularly since the transverse strut 20 of the handle 2 is also lowered into the groove 31 in the latching position.

A pin 33 is disposed on the underside of the transverse strut 20 and in the assembly position adjoins the locking slide. Its length is chosen so that in this position the tips of the locking arms 2*a,* 2*b* just extend into the slots 9*a,* 9*b.*

Figure 4:
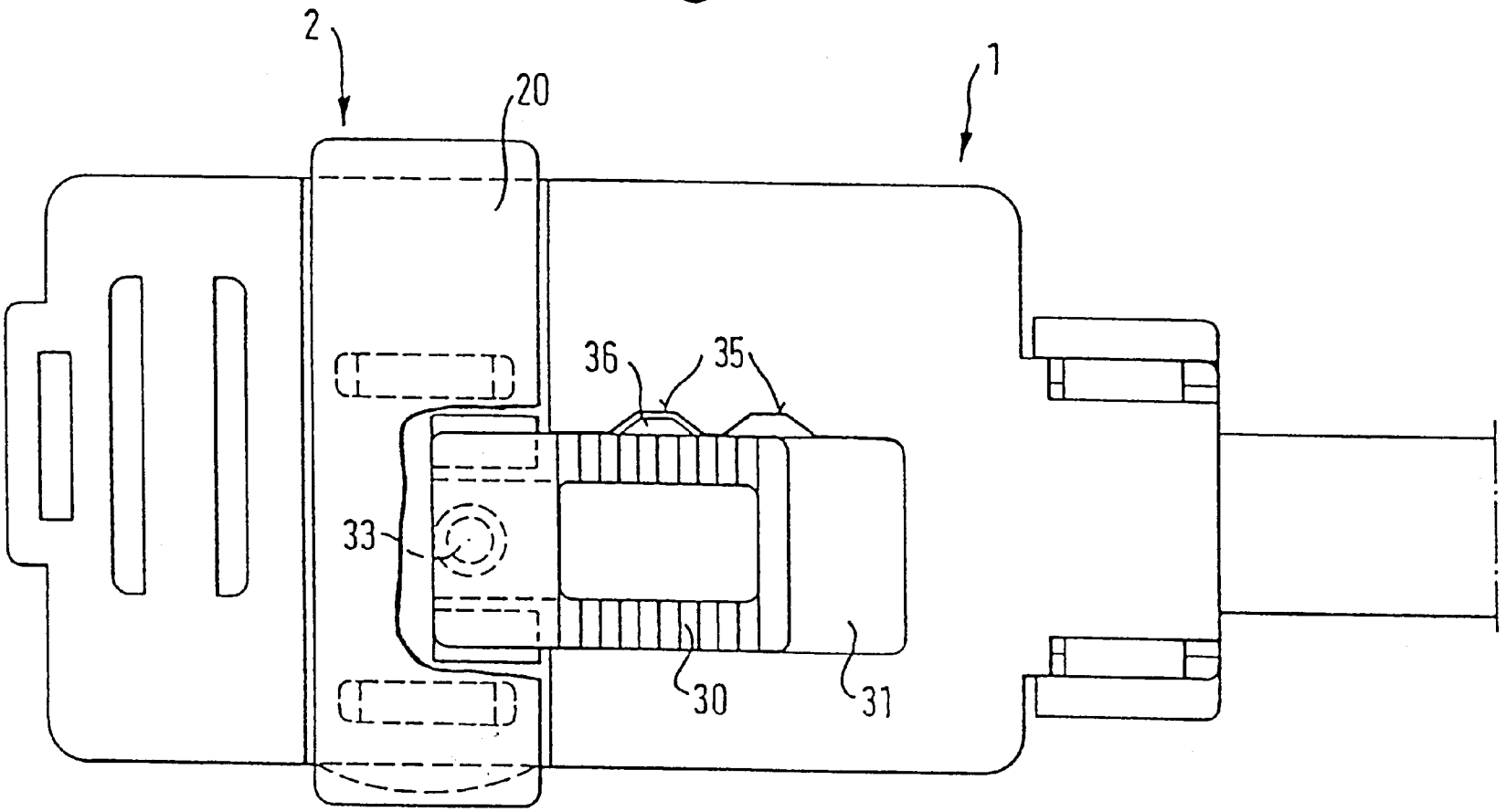
FIG. 4 shows the latching-preventing means in FIG. 3 in plan view.

FIG. 4 is a plan view of the locking slide 30 on the casing lid. The drawing shows an alternative means of securing the locking slide 30, two recesses 39 being provided at the side in the groove 31, for a latch 36 disposed in the side wall of the locking slide 30. In the final latched position, the handle 2 along with the locking slide 30 can be pressed down so far that its surface is flush with the casing lid surface.

FIG. 5 shows an alternative embodiment preventing accidental latching of the handle in the final position. In this embodiment the complete handle 2 is moved sideways in a groove 13*b* transversely to the direction of insertion 6, into a position in which the locking arms 2*a,* 2*b* can enter the slots 9*a,* 9*b.* FIG. 5 shows the lateral groove 13*b,* in which the wings 11*a,* 11*b* of the handle 2 are guided. Ribs 23 bound the lateral travel distance and prevent any accidental pressure on the handle 2 from spreading out the wings 11*a,* 11*b* in a position in which the locking arms 2*a,* 2*b* cannot enter the slots 9*a,* 9*b.* In addition the connector is constructed so that in the initial latch position the locking arms 2*a,* 2*b* additionally or alternatively extend upwards from the base of the casing and accidental actuation is impossible. The casing and the inside of the wings 11*a,* 11*b* are formed with knobs and recesses 25, 26, so that it is possible to detect when the handle is latched in the intermediate position. Latching of this kind is optional and can be omitted if required.

FIGS. 6*a* to 6*c* show a perspective view of the connector according to FIG. 5 in the initial latching position (FIG. 6*a*) in which the handle 2 cannot be pressed down. In order to reach the final position, the handle 2 must first be moved sideways into the position shown in FIG. 6*b,* so that it can then be pressed down into the end position (FIG. 6*c*). *As can be seen, in this version also the handle 2 is flush with the surface of the connector casing lid, so that the connector is flat.*

FIG. 7 shows a plug part (1) as a whole comprising an attachment 10 inserted into a complementary plug (not shown) and also comprising a flat casing. The lateral cable outlet is shown on the right side. A cable 46, indicated by chain lines, comes out of the cable outlet 40. The upper part of the connector is covered by a lid 44. A locking handle 45 extends through the lid down to latching arms which extend parallel to the plug attachment, in order to secure the connector after installation.

The cable outlet 40 has a two-part clamping device 50*a,* 50*b* which will be explained in detail hereinafter. A part of the clamping device 50*a* comprises a hollow semicylindrical groove formed with retaining ribs 47. A cable 46 is inserted in the groove and, when the casing components are fitted together in the specified manner, the retaining ribs are partly pressed into the cable sheath transversely to the cable axis. The upper part 50*a* of the clamping device is in the form of a side attachment 48 moulded in one piece on the lid 44 and has an upper wall 60, the underside of which is formed with the upper groove 50*a* in its centre. The attachment 48 also has two vertical side walls 51*a* and 51*b.* Latches are formed on the insides of the side walls 51*a* and 51*b* and cooperate with corresponding complementary detents 53. The detents 53 are on the second part of the clamping device 50*b,* which is likewise in the form of an attachment or clamp 49 integral with the casing. The clamp 49 likewise has a central semicylindrical groove with retaining ribs 47 forming the counterpart to the groove 50*a,* the cable 46 being clamped between them. On the two sides of the groove 50*b* the clamp has two arms 56, substantially following the contour of the inner side walls, and their lower outer ends are flush with the lower edges of the vertical side walls 51*a,* 51*b* of attachment 48. The detents 53 and the corresponding latches 52 are disposed closely above the lower end of the side walls 51*a,* 51*b* or the arms 56. Preferably, the arms 56 are prestressed slightly outwards when cast, so that when the attachment 48 is locked to the clamp 49, the detents 53 are pressed into the latches 52.

If a force is exerted on the lid 54 by an obliquely upward or backward pull in opposition to the direction of insertion, tending to loosen the lid from the casing, application of a force in this direction will press the detent 53 more deeply into the corresponding latch 52 and, if the side walls 51*a,* 51*b* yield outwardly, the arms 56 will follow the yielding movement, with the result that the detents 53 cannot be removed from the latches; on the contrary, the two parts of the clamping device are joined together even more firmly. The greater the pull from the direction of the lid and the further the side walls or arms of the clamp move apart, the more firmly the locking device spreads into the undercut of the lid.

This ensures that the parts of the casing cannot come loose and the cable cannot be pulled out in the axial direction, since the parts of the clamping device 50*a,* 50*b* always remain firmly pressed together.

The preceding description of embodiments of the invention should not be regarded as limitative but only by way of illustration.

What is claimed is:

1. A connector with secondary latching comprising, a handle including portions for filling slots in said connector, the handle being supported on a plug part for movement along an axis of the plug part oriented in a direction of insertion of the plug part in a socket part, the plug part including tongues having a latch for insertion into each slot, the handle being movable in the connector along the axis, to latch on the plug part of the connector in two positions, a first position in which the slots are not filled by the portions of the handle, and a second position, in which the portions of the handle fill the slots.

2. The connector according to claim 1, wherein the plug part has at least two tongues and latches disposed opposite one another and extending parallel to the axis, said socket part having said slots correspondingly disposed for receiving the tongues and latches and for latching the latches to correspondingly situated shoulders of said socket part, and wherein, unfilled slots remain between the plug part and the tongues, the portions of the handle comprising two locking arms for filling the unfilled slots to hold the tongues and latches along the axis and to press the latches on the tongues non-releasably into an undercut on the shoulders.

3. The connector according to claim 1, wherein the plug part is flat with a cable outlet, and the handle in the second position is incorporated into the contour of a back wall of the plug part.

4. The connector according to claim 1, wherein the tongues on the plug part can be inserted into the corresponding slots in the socket part only when the handle is in the first position.

5. The connector according to claim 1, comprising part of a restraining system in a motor vehicle.

6. A connector with secondary latching comprising, a handle including portions for filling slots in said connector, the handle being supported on a plug part for movement along an axis of the plug part oriented in a direction of insertion of the plug part in a socket part, the plug part including tongues having a latch for insertion into each slot, the handle being moveable in the connector along the axis, to latch on the plug part of the connector in two positions, a first position in which the slots are not filled by the portions of the handle, and a second position, in which the positions of the handle fill the slots; and wherein the plug part has at least two tongues and latches disposed opposite one another and extending parallel to the axis, said socket part having said slots correspondingly disposed for receiving the tongues and latches and for latching the latches to correspondingly situated shoulders of said socket part, and wherein, unfilled slots remain between the plug part and the tongues, the portions of the handle comprising two locking arms for filling the unfilled slots to hold the tongues and latches along the axis and to press the latches on the tongues non-releasably into an undercut on the shoulders; and wherein a back of the plug part is surrounded by two wings of the handle which extend over side walls of the plug part, and wherein the lower ends of the wings end in hooks which in said first position engage in grooves in the side walls of the plug, with the locking arms not being inserted into the slots, and wherein in said second position the hooks engage under a lower edge of the side walls in order to lock the handle in the position where the tongues are locked.

* * * * *